United States Patent [19]

Burton, III

[11] 4,178,039

[45] Dec. 11, 1979

[54] WATER TREATMENT AND HEATING IN SPENT SHALE OIL RETORT

[75] Inventor: Robert S. Burton, III, Grand Junction, Colo.

[73] Assignee: Occidental Oil Shale, Inc., Grand Junction, Colo.

[21] Appl. No.: 873,667

[22] Filed: Jan. 30, 1978

[51] Int. Cl.[2] ..... E21C 41/10

[52] U.S. Cl. ..... 299/2; 166/259; 210/170; 165/45

[58] Field of Search ..... 299/2, 4, 5, 11; 166/256, 259, 260, 261, 305 D; 61/0.5; 210/170

[56] References Cited

U.S. PATENT DOCUMENTS

| | | | |
|---|---|---|---|
| 3,196,945 | 7/1965 | Craig et al. | 166/261 |
| 3,502,372 | 3/1970 | Prats | 166/261 X |
| 3,510,255 | 5/1970 | Hall et al. | 23/52 |
| 3,572,838 | 3/1971 | Templeton | 299/4 |
| 3,588,175 | 6/1971 | Whiting | 299/11 |
| 3,642,433 | 2/1972 | Dyni | 23/52 |
| 3,734,184 | 5/1973 | Scott | 166/261 |
| 3,768,865 | 10/1973 | Dehn | 166/305 D |
| 3,987,851 | 10/1976 | Tham | 166/256 |
| 4,015,663 | 4/1977 | Strubhar | 166/259 |
| 4,016,239 | 4/1977 | Fenton | 423/155 |
| 4,036,299 | 7/1977 | Cha et al. | 166/259 X |

*Primary Examiner*—Ernest R. Purser

*Attorney, Agent, or Firm*—Christie, Parker & Hale

[57] ABSTRACT

An in situ fragmented permeable mass of particles containing treated oil shale is formed by excavating a void in a subterranean formation containing oil shale, explosively expanding formation toward such a void to form a fragmented permeable mass of formation particles containing oil shale, and retorting the particles containing oil shale in the fragmented mass. Water containing impurities is introduced into such an in situ fragmented permeable mass of particles containing treated oil shale, i.e., retorted or combusted oil shale or both, for disposal, purification, or generation of steam. The water introduced can be water containing hydrocarbons such as process water from retorting oil shale or water containing suspended solids such as blowdown from a steam generator. When the fragmented permeable mass is still hot from retorting, steam is generated which can be withdrawn for use in oil shale recovery operations. When the fragmented permeable mass does not contain particles at a high enough temperature for steam generation, water containing impurities can be purified by percolating it through the mass. A hot fragmented permeable mass can be used in turn for steam generation until it has cooled, then for removing impurities from water until it becomes too heavily contaminated, and finally for disposal of water containing impurities.

11 Claims, 1 Drawing Figure

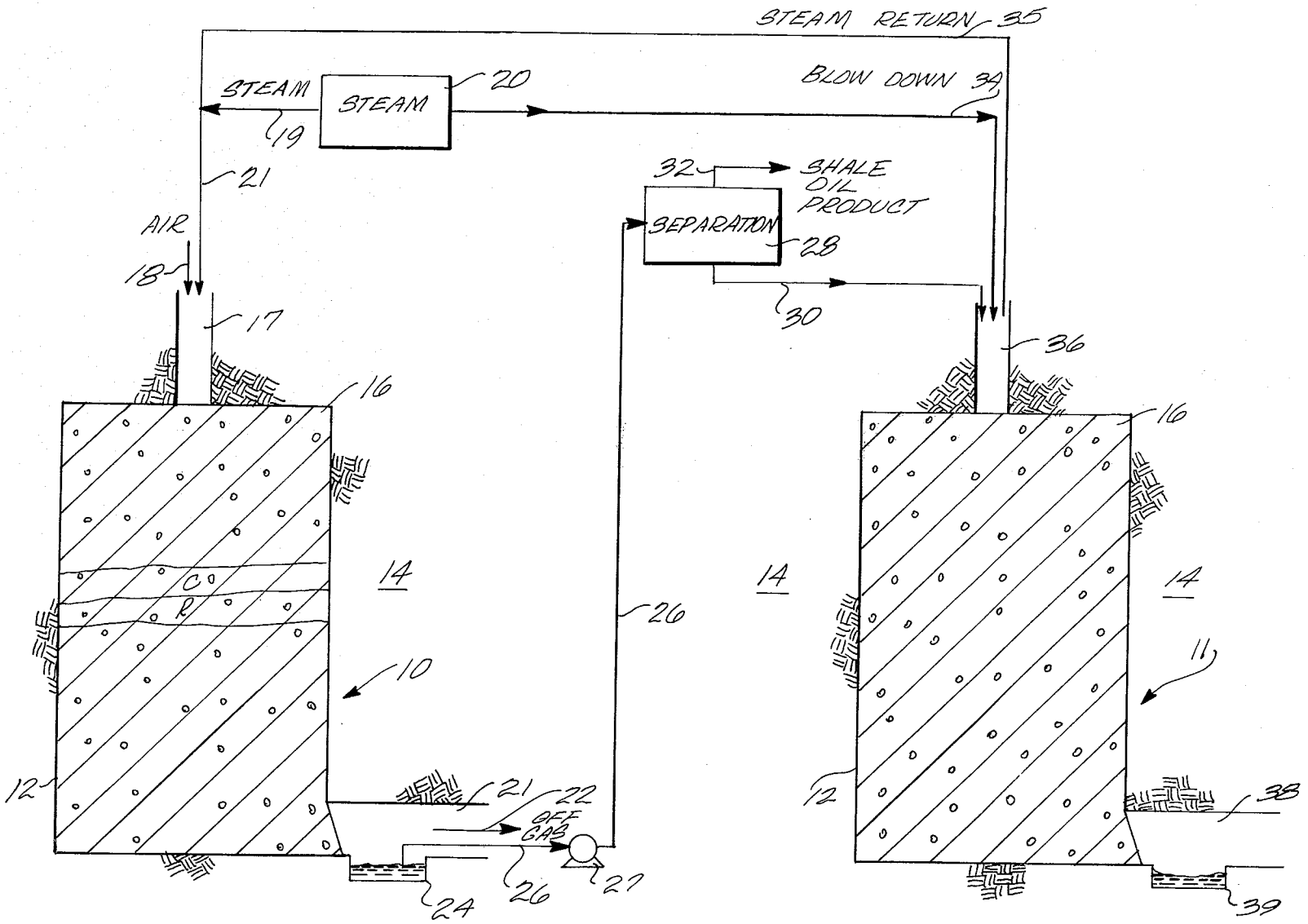
STEAM RETURN
35
BLOW DOWN
34
SHALE OIL PRODUCT
28
SEPARATION
32
30
36
16
14
11
38
39
12
14
26
27
22
OFF GAS
21
26
24
20
STEAM
STEAM
19
21
16
14
10
17
AIR
18
12

WATER TREATMENT AND HEATING IN SPENT SHALE OIL RETORT

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen", which upon heating decomposes to produce hydrocarbon liquid and gaseous products. It is the formation containing kerogen that is called "oil shale" herein, and the liquid hydrocarbon product is called "shale oil".

A number of methods have been proposed for processing oil shale which involve either first mining the kerogen bearing shale and processing the shale above ground, or processing the shale in situ. The latter approach is preferable from the standpoint of environmental impact since the spent shale remains in place, reducing the chance of surface contamination and the requirement for disposal of solid waste.

The recovery of liquid and gaseous products from oil shale deposits has been described in several patents, one of which is U.S. Pat. No. 3,661,423, issued May 9, 1972 to Donald E. Garrett, assigned to the assignee of this application, and incorporated in its entirety herein by this reference. This patent describes in situ recovery of liquid and gaseous hydrocarbon materials from a subterranean formation containing oil shale by mining out a portion of the subterranean formation and then fragmenting and expanding a portion of the remaining formation to form a fragmented, stationary, permeable mass of formation particles containing oil shale, referred to herein as an in situ oil shale retort. Hot retorting gases are passed through the in situ oil shale retort to convert kerogen contained in the oil shale to liquid and gaseous products.

One method of supplying hot retorting gases used for converting kerogen contained in the oil shale, as described in U.S. Pat. No. 3,661,423, includes establishment of a combustion zone in the retort and introduction of a combustion zone feed containing oxygen downwardly into the combustion zone to advance the combustion zone downwardly through the retort. The combustion zone feed can contain steam provided by a steam generator to improve efficiency of retorting. In the combustion zone oxygen in the combustion zone feed is depleted by reaction with hot carbonaceous materials to produce heat and combustion gas. By the continued introduction of the oxygen supplying combustion zone feed downwardly into the combustion zone, the combustion zone is advanced downwardly throught the retort.

The effluent gas from the combustion zone comprises combustion gas and any gaseous portion of the combustion zone feed that does not take part in the combustion process. This effluent gas passes through the retort on the advancing side of the combustion zone to heat the oil shale in a retorting zone to a temperature sufficient to produce kerogen decomposition, called retorting, in the oil shale to gaseous and liquid hydrocarbon products and a residue of solid carbonaceous material.

The liquid products and gaseous products are cooled by cooler oil shale fragments in the retort on the advancing side of the retorting zone. An off gas containing combustion gas generated in the combustion zone, product gas produced in the retorting zone, gas from carbonate decomposition, and any gaseous combustion zone feed that does not take part in the combustion process is withdrawn to the surface. Liquid hydrocarbon products, together with water produced in or added to the retort, are also withdrawn to the surface as a liquid product stream through an access tunnel, drift or shaft. The liquid hydrocarbon products are separated from the water in the liquid product stream using methods such as decanting.

Water recovered from the retorting operation can contain up to about 1% by volume of shale oil and related hydrocarbons. The presence of hydrocarbons in the water renders it useless for many applications without costly purification. Disposal of blowdown from the unit used for generation of steam for introduction to the retort as part of the oxygen supplying gaseous feed mixture can be a problem. Because the blowdown is heavily contaminated by dissolved and suspended mineral solids, it is useless for many applications without costly purification.

Methods proposed for purifying water recovered as liquid product from retorting and steam generator blowdown include use of settling basins, filters, screens, skimmers, flocculating agents, trickling filters, biofilters, osmotic filters, ion exchange resins and the like. However, all these methods require investment in capital equipment and maintenance and operating expenses. Furthermore, it is sometimes desired simply to dispose of heavily contaminated water.

Therefore, there is a need for a simple, inexpensive, economical method for removing impurities from water such as dissolved and suspended hydrocarbons contained in water from retorting oil shale and solids contained in steam generator blowdown. There is also a need for an economical method of generating steam from water containing impurities without the need for first purifying the water and without the use of additional scarce fossil fuels. In addition, there is a need for a way of disposing of contaminated water.

The present invention concerns a method having the above features for generating steam from water containing impurities, for removing impurities from water, and/or for disposing of water containing impurities. According to this method, an in situ fragmented permeable mass of particles containing treated oil shale in an in situ oil shale retort in a subterranean formation containing oil shale is provided by excavating a first portion of formation to form at least one void within the boundaries of an in situ oil shale retort site; explosively expanding a second portion of formation within the boundaries of the in situ oil shale retort site toward such a void to form a fragmented permeable mass of formation particles containing oil shale in such an in situ oil shale retort; and retorting the particles containing oil shale in the fragmented mass to produce an in situ fragmented permeable mass of particles containing treated oil shale.

Water containing hydrocarbon impurities or suspended solids impurities is introduced into such a fragmented permeable mass of particles containing treated oil shale, i.e. retorted or combusted oil shale or both, in a spent in situ oil shale retort, and water having a lower concentration of impurities can be withdrawn either as steam or as liquid water. When the fragmented permeable mass is still hot from retorting, steam is generated. When the fragmented permeable mass is cool, or has cooled in the process of steam generation, liquid water having a lower concentration of impurities than the introduced water can be withdrawn from the mass of particles, or the water can be left in the mass of particles for disposal.

This method is useful for removing hydrocarbon impurities from water such as water separated from a liquid product stream obtained by retorting oil shale. This method is also useful for removing solids from water such as blowdown obtained from a steam generator used for providing steam for retorting oil shale.

It is useful for generating steam from water containing dissolved or undissolved hydrocarbons or dissolved or undissolved mineral impurities without the need for first purifying the water, and also for disposing of such water when desired. In a preferred embodiment, steam containing hydrocarbons is generated from water containing hydrocarbon impurity by introducing such water into a hot spent retort, and the steam is introduced into an active retort as part of the combustion zone feed. The hydrocarbon content of the steam is thereby utilized as fuel in the combustion zone of the active retort.

The fragmented permeable mass of particles is contained in an in situ oil shale retort in a subterranean formation containing oil shale. Since the fragmented mass containing treated oil shale remains in place under ground, the chance of surface contamination by the impurities removed from the water is reduced.

DRAWING

These and other features, aspects and advantages of the present invention will become more apparent upon consideration of the following description, appended claims, and accompanying drawing which schematically represents in vertical cross section an active and a spent in situ oil shale retort, where the active in situ retort and a steam generator are producing water containing impurities, the water is being introduced into the spent in situ retort, and steam is recycled from the spent retort to the active retort.

BRIEF DESCRIPTION OF THE INVENTION

Referring to the drawing, an active in situ oil shale retort 10 and a spent oil shale retort 11 are each in the form of a cavity 12 in an unfragmented subterranean formation 14 containing oil shale. Each cavity contains a fragmented permeable mass 16 of formation particles containing oil shale, with the spent retort 11 containing treated oil shale, i.e. retorted or combusted oil shale or both. The fragmented mass in the spent retort 11 is still hot from recently completed retorting.

The fragmented mass can have a wide distribution of particle sizes. For example, an in situ oil shale retort in the Piceance Creek Basin of Colorado prepared by explosive expansion of formation toward a void contains a fragmented permeable mass comprising about 58% by weight particles having a weight average diameter of about 2 inches, about 23% by weight particles having a weight average diamenter of about 8 inches, and about 19% by weight particles having a weight average diameter of about 30 inches. Each cavity 12 can be created simultaneously with fragmentation of the mass of formation particles 16 contained therein by blasting by any of a variety of techniques.

A desirable technique involves excavating a void within the in situ oil shale retort site and explosively expanding remaining oil shale in the site toward the void. A method of forming an in situ oil retort is described in U.S. Pat. No. 3,661,423, which is incorporated herein in its entirety by this reference.

According to this method, an undercut or void is excavated to the length and width of the in situ oil shale retort being formed. A plurality of small support pillars are left in the undercut. The undercut can be excavated from an access drift which can be at the elevation of the bottom boundary of the retort being formed.

A variety of other techniques can also be used. For example, one or more horizontal voids can be excavated within the boundaries of the site of the in situ oil shale retort being formed, as described in U.S. patent application Ser. No. 659,899, filed on Feb. 20, 1976, now U.S. Pat. No. 4,043,598 assigned to the assignee of this application, and incorporated herein in its entirety by this reference. According to the method described in the Ser. No. 659,899 application, a first chamber or void can be formed at the bottom boundary and a second chamber or void can be formed at the top boundary of the in situ oil shale retort site in the subterranean formation. An intermediate void can be provided above the bottom void and below the top void. The top void can extend substantially completely across the top boundary of the retort to be formed in the formation. Access to the formation for excavating the bottom, top and intermediate voids can be provided by a bottom access drift, a top access drift, and an intermediate access drift, respectively. As used herein the term "drift" includes tunnels, adits, and the like.

An alternate mining scheme for preparation of a retort is described in U.S. patent application Ser. No. 603,704, filed on Aug. 11, 1975, now U.S. Pat. No. 4,043,595 assigned to the assignee of this invention, and incorporated herein in its entirety by this reference. According to patent application Ser. No. 603,704, one or more columnar voids, each void having a vertically extending free face, can be excavated in the subterranean formation containing oil shale. The columnar void can be cylindrical or can be a slot having one or more large, parallel, planar vertical free faces. An access drift can be provided in the subterranean formation at the bottom boundary of an in situ oil shale retort to be formed in the formation for excavating the vertically extending void.

The total volume of the excavated void or voids is typically less than about 40% of the total volume of the retort being formed, more often less than about 20%, and above about 10% of the total volume. A void fraction of about 15% is particularly preferred. When formation is fragmented, the excavated void volume becomes distributed throughout the resulting fragmented mass, providing a fragmented mass of high permeability and low resistance to gas flow.

When the fragmented shale particles are later retorted, they increase in size. Part of this size increase is temporary and results from thermal expansion, and part is permanent and is brought about during the retorting of the kerogen in the shale. Providing a void fraction of above about 10% in the fragmented mass before retorting allows this expansion of the particles to occur upon retorting without unduly restricting gas flow.

After excavating one or more voids in the subterranean formation, means for explosively expanding unfragmented formation such as columnar charges of explosive are provided in the subterranean formation. The remaining formation within the boundaries of an oil shale retort being formed is fragmented by explosive expansion toward such an excavated void to form a fragmented permeable mass of formation particles containing oil shale.

A useful technique for forming a retort is described in U.S. patent application Ser. No. 603,705, filed on Aug. 11, 1975, now U.S. Pat. No. 4,043,596, assigned to the assignee of this invention, and incorporated herein in its entirety by this reference. According to patent application Ser. No. 603,705, a retort is formed by excavating one or more slot shaped columnar voids each having a pair of vertically extending, planar free faces, placing explosive in blasting holes drilled parallel to the faces, and explosively expanding the shale adjacent to the columnar void one directionally toward each free face in one or more planar layers severed in a sequence progressing away from each free face, the explosive being detonated in a single round.

A conduit 17 communicates with the top of the fragmented mass of formation particles 16 in the active retort 10. There is a combustion processing zone C established in the retort and advanced downwardly through the retort 10 by introduction of a combustion zone feed containing an oxygen supplying gas into the in situ oil shale retort through the conduit 17. The oxygen supplying gas can be air 18 or air mixed with other gases such as steam 19 from a steam generator 20 or steam return line 35. As the gaseous feed is introduced to the retort, oxygen oxidizes carbonaceous material in the oil shale to produce combustion gas. Heat from the exothermic oxidation reactions carried by flowing combustion gas advances the combustion zone downwardly through the fragmented mass of particles.

Combustion gas produced in the combustion zone and any gaseous unreacted portion of the combustion zone feed are passed through the fragmented mass of particles on the advancing side of the combustion zone to a retorting processing zone R on the advancing side of the combustion zone. Kerogen in the oil shale is retorted in the retorting zone to liquid and gaseous products.

As used herein, by the term "active retort", there is meant a retort undergoing retorting and/or combustion, and by the term "spent retort", there is meant a retort in which retorting has been substantially completed, that is, a retort in which a retorting zone has been passed through substantially the entire fragmented permeable mass of formation particles contained in the retort. It should be recognized that such a spent retort can in fact contain unretorted oil shale because of variations in particle size and gas flow, and also because the retorting or combustion process is sometimes stopped short of the bottom of the fragmented mass particles containing oil shale in order to avoid the withdrawal of excessively hot off gas from the retort. As used herein, the term "retorted oil shale" refers to oil shale heated to sufficient temperature to decompose kerogen in an environment substantially free of free oxygen so as to leave a solid residual carbonaceous material. The term "combusted oil shale" refers to oil shale of reduced carbon content due to oxidation by a gas containing free oxygen. The term "raw oil shale " refers to oil shale which has not been subjected to processing for decomposing kerogen in the oil shale.

There is an adit, tunnel, drift 21 or the like in communication with the bottom of the active retort 10. An off gas 22 containing gaseous products, combustion gases, gas from carbonate decomposition, and any gaseous unreacted portion of the combustion zone feed is withdrawn from the active in situ oil shale retort 10 by way of the drift 21 or via a conduit (not shown).

The drift 21 contains a sump 24 in which a liquid product containing water and hydrocarbons is collected. Liquid product is withdrawn through line 26 and transferred by pumping means 27 to separation means 28 such as a decanting vessel, filter means, heater-treater or settling basin in which water 30 is separated from the hydrocarbons or shale oil product 32. The water 30 can comprise water produced by combustion in the retort, water released from formation particles during the retorting operation, and water introduced into the retort such as steam 19 from the boiler 20. The water 30 separated from the shale oil product 32 can contain about 1% by volume hydrocarbon impurities.

Another source of impure water from retorting the mass of particles in the active retort 10 is blowdown 34 from the steam generator 20. The blowdown 34 is water released from the steam generator to maintain the concentration of dissolved and suspended solids in the water inventory in the generator sufficiently low to avoid scale and sludge formation. This blowdown, which can be continuous or intermittent, can contain solids such as sodium phosphate salts, sludge, silica, and the like, which depending upon the pressure used in the steam generator, can range from about 1000 to 3500 parts per million by weight in the boiler blowdown.

Because of the solids contamination of the blowdown 34 and the hydrocarbon contamination of the water 30 from retorting, these water streams are of limited utility for irrigation and most domestic requirements. In addition, these process water streams are unsuitable for generation of steam in a steam generator such as the steam generator 20 used for generating steam for introduction into the active retort 10. These process water streams also are unsuitable for use in mining operations for preparation of an in situ oil shale retort. Water is required in mining operations for wetting down muck piles to avoid dust contamination of air in underground workings. Water containing hydrocarbons is unsuitable for this use. Water is also used in mining operations for cooling drill bits and for carrying away cuttings from drill bits. Water containing suspended solids can plug the pumps used for pumping water for these purposes. Since most oil shale formations are in the Western United States, where water is a valuable commodity, it is desirable to treat these water streams to render them free of impurities so they can be used for steam generation, mining operations, irrigation, and the like. Use of process water for purposes to which it can be made suitable makes other water available for purposes where higher purity is needed. As used here, the term "process water from retorting oil shale" is intended to include process water containing hydrocarbon impurities, process water containing dissolved and/or suspended mineral solids, and mixtures of such process waters.

Therefore, according to a method of this invention, water containing impurities, such as water 30 obtained from retorting the mass of particles in the active retort 10 and blowdown 34 from the steam generator 20, is introduced through at least one conduit 36 in communication with the upper boundary of the fragmented permeable mass of formation particles containing treated oil shale in the spent retort 11.

In a spent retort in which retorting has recently been completed, considerable heat is retained in the fragmented permeable mass of formation particles containing treated oil shale. When at least a portion of the permeable mass is at a sufficiently high temperature to generate steam, a portion of the retained heat may be recovered by generation of steam in accordance with this invention. At least part of the water is turned to steam upon contact with the hot fragmented permeable mass. The resulting steam is withdrawn from the top of the retort through a steam return line 35, or from the bottom of the retort through the drift 38 via a conduit (not shown). Preferably, the fragmented mass is hot enough, i.e., has sufficient heat content at a high enought temperature, to convert to steam a substantial portion, e.g., at least about half, of the water introduced. With continued introduction of water to the spent retort 11 the upper portion of the retort will cool and cease to generate steam, and then water will percolate deeper into the retort to vaporize in areas which are still hot. The withdrawn steam can be mixed with steam from the steam generator 20 and introduced into the active retort 10 as part of the combustion zone feed.

When steam is generated in accordance with this invention from water containing hydrocarbon impurity, a portion of the hydrocarbon may be vaporized and carried along with the steam. This is desirable when the steam is introduced into the active retort, because the hydrocarbon serves as fuel in the combustion zone and its heating value is therefore recovered.

Preferably more than one conduit is used to introduce the water in order to avoid channeling of water through one portion of the fragmented mass and to achieve a more uniform distribution of water. In this way, as much as possible of the heat contained in the fragmented mass is used for the generation of steam.

For economy, the conduit 36 used for introducing combustion zone feed to the spent retort 11 when it is active is utilized for introducing the water containing impurities into the spent retort. Similarly, the drift 38 used for withdrawing products from the spent retort when the retort is active is utilized to withdraw from the bottom of the retort effluent steam which descends to the bottom of the retort. The steam withdrawn from the retort is of relatively lower impurity concentration than the water introduced to the spent retort through the conduit 36.

After a time, the fragmented permeable mass 16 of formation particles containing treated oil shale in spent retort 11 is cool enough that no more than a minor proportion of the water introduced is vaporized. In some circumstances the spent retort can be cool enough when water is first introduced that little steam is generated. At least part of the water introduced percolates downwardly through the mass of particles in the spent retort 11 to be withdrawn from the retort through the drift 38 which is in communication with the bottom of the inactive retort.

The effluent water withdrawn from the bottom of the retort can have a relatively lower concentration of organic and suspended inorganic impurities than the water introduced to the retort through the conduit 36. This water is collected in the sump 39 in the drift and is withdrawn through the drift via a conduit (not shown). Pumping means (not shown) can be provided for transferring the effluent water to the surface.

It is believed that impurities suspended in the introduced water are removed from the water by a filter-like action where the fragmented body or mass 16 of formation particles in the spent retort 11 acts as a filter bed to remove suspended oil droplets and mineral particles from the introduced water.

The method of this invention provides great versatility in removing impurities from water. It can be used for removing impurities from blowdown from one or more steam generators and/or impurities from water from one or more oil shale retorts. This method also can be used for removing suspended solids and oils from water streams other than steam generator blowdown and retort water such as municipal waste water, water decanted from oil pumped from oil wells, refinery and chemical plant effluents, and the like.

Preferably there is a sufficient mass of fragmented particles providing a sufficient filtering effect to remove substantially all of the suspended oil and particles in the water introduced to the retort 11. However, with continued addition of impure water to the inactive retort, reduced effectiveness of the retort in removing impurities from water can result. When this occurs it can be necessary to pass effluent water 40 containing impurities through additional in situ retorts containing a fragmented permeable mass of formation particles containing treated oil shale to achieve adequate removal of impurities.

The treated oil shale in the spent in situ oil shale retort is highly porous and permeable and contains appreciable amounts of unburned residual carbon present in a relatively active form because of its formation from decomposed kerogen. The fragmented permeable mass containing treated oil shale can remove impurities from water both by mechanical filtration and by adsorption onto the treated shale or onto the active carbon contained therein. Thus, both suspended and dissolved hydrocarbons can be removed from the water being treated.

The spent retort 11 may also be used for disposal of water containing impurities, for example, when it is no longer being used for steam generation or for removing impurities from water, by introducing such water into the retort and leaving it there. The drift 38 at the bottom of the retort may be sealed to help contain the water within the retort. An advantage of using a fragmented permeable mass of particles containing treated oil shale for the disposal of water containing impurities is that treated oil shale absorbs substantial amounts of water per unit mass of oil shale.

By utilizing treated oil shale in situ for the generation of steam, heat which would otherwise be lost is recovered and scarce fossil fuels are conserved. By utilizing treated oil shale in situ for the purification of water, the purchase of an absorbent, ion exchange resin, filter medium, or the like is avoided, and carbonates in the treated oil shale react with and remove sulfurous compounds from the water. The oil shale used remains in the ground thereby eliminating any disposal problems. In addition, since the retort containing the fragmented permeable mass of formation particles containing treated oil shale is formed for recovery of shale oil regardless of any need to purify water, high capital costs for special facilities to remove impurities from water are avoided. Furthermore, permanent disposal of water containing impurities in the retort is advantageous because the fragmented permeable mass of formation particles containing treated oil shale is absorbent and is surrounded by relatively impermeable raw oil shale.

It has been found experimentally that spent oil shale does remove organic contaminants from impure water such as process water from an in situ oil shale retort. It has also been found that removed contaminants can be leached from the spent shale by fresh water. Furthermore, spent shale can contain metal oxides and water-soluble minerals that can affect the pH and dissolved solids content of water entering a spent in situ oil shale retort. For these reasons, care should be taken to select a retort for practice of this invention that is not in liquid communication with an aquifer that can be deleteriously affected thereby.

Although this invention has been described in detail with reference to certain embodiments thereof, other embodiments of the invention are contemplated. For example, impure water can be introduced at a level below the top of the mass of particles containing treated oil shale to flow downwardly by gravity flow or impure water can be forced upwardly through a mass of particles containing treated oil shale in a spent in situ oil shale retort. Water or steam may be withdrawn from a spent retort and commingled with water or steam from another source, such as another spent retort or a steam generator. The resulting mixed water or steam can then be used in any process for which it has sufficient purity. Process water such as water separated from shale oil product, steam generator blowdown, cooling water, and other waste water can be combined, for example, in an effluent pond or sump, and the resulting water mixture can be introduced into a spent retort for steam generation, removal of contaminants, or disposal. Thus, the foregoing descriptions are intended to illustrate but not to limit the invention, the scope of which is defined in the appended claims.

What is claimed is:

1. A method for processing oil shale in an in situ oil shale retort in a subterranean formation containing oil shale comprising the steps of:

excavating a first portion of formation to form at least one void within the boundaries of an in situ oil shale retort site;

explosively expanding a second portion of formation within the boundaries of the in situ oil shale retort site towards such a void to form a fragmented permeable mass of formation particles containing oil shale in such an in situ oil shale retort;

retorting the particles containing oil shale in the fragmented mass to produce an in situ fragmented permeable mass of particles containing treated oil shale in a spent in situ retort;

introducing water containing undissolved impurities into an upper portion of the spent in situ retort; and withdrawing water from a lower portion of the spent retort having a concentration of undissolved impurities lower than the concentration of undissolved impurities in the introduced water.

2. A method as claimed in claim 1 in which the introduced water contains hydrocarbon impurities.

3. A method as claimed in claim 1 in which the introduced water comprises steam generator blowdown containing undissolved solids.

4. A method as claimed in claim 1 in which the introduced water comprises process water from retorting oil shale.

5. A method for processing oil shale in an in situ oil shale retort in a subterranean formation containing oil shale comprising the steps of:

excavating a first portion of formation to form at least one void within the boundaries of an in situ oil shale retort site;

explosively expanding a second portion of formation within the boundaries of the in situ oil shale retort site towards such a void to form a fragmented permeable mass of formation particles containing oil shale in such an in situ oil shale retort;

retorting the particles containing oil shale in the fragmented mass to produce an in situ fragmented permeable mass of particles containing treated oil shale in a spent in situ retort;

introducing water containing dissolved hydrocarbon impurities into an upper portion of the spent retort; and withdrawing water from a lower portion of the spent retort having a concentration of dissolved hydrocarbon impurities lower than the concentration of dissolved hydrocarbon impurities in the introduced water.

6. A method for processing oil shale in an in situ oil shale retort in a subterranean formation containing oil shale comprising the steps of:

excavating a first portion of formation to form at least one void within the boundaries of an in situ oil shale retort site;

explosively expanding a second portion of formation within the boundaries of the in situ oil shale retort site towards such a void to form a fragmented permeable mass of formation particles containing oil shale in such an in situ oil shale retort;

retorting the particles containing oil shale in the fragmented mass to produce an in situ fragmented permeable mass of particles containing treated oil shale in a spent in situ retort;

introducing water into the spent in situ retort, at least a portion of the fragmented mass in the spent retort being at a sufficient temperature to generate steam; and withdrawing steam from the spent in situ retort.

7. A method as claimed in claim 6 in which the water is introduced at the top of the spent retort and steam is withdrawn from the top of the spent retort.

8. A method as claimed in claim 6 in which the water contains hydrocarbon impurities and steam containing vaporized hydrocarbons is withdrawn.

9. A method as claimed in claim 6 in which the water comprises steam generator blowdown containing dissolved solids.

10. A method as claimed in claim 6 in which the water comprises steam generator blowdown containing undissolved solids.

11. A method as claimed in claim 6 in which the water comprises process water from retorting oil shale.

* * * * *